United States Patent [19]

Bretz

[11] Patent Number: 4,507,937

[45] Date of Patent: Apr. 2, 1985

[54] VEHICLE REFRIGERATION UNIT AND MOUNTING ASSEMBLY

[75] Inventor: Frank E. Bretz, Elmhurst, Ill.

[73] Assignee: Ajax Consolidated Co., Chicago, Ill.

[21] Appl. No.: 512,664

[22] Filed: Jul. 11, 1983

[51] Int. Cl.[3] ..... F25D 19/00

[52] U.S. Cl. ..... 62/298; 248/558; 165/76; 308/3 R

[58] Field of Search ..... 62/298; 248/558; 165/76, 77, 78; 308/3 R, 3.6, 3.9

[56] References Cited

U.S. PATENT DOCUMENTS

| | | |
|---|---|---|
| 2,910,879 | 11/1959 | Hanks . |
| 3,017,226 | 1/1962 | Sloyan . |
| 3,421,724 | 1/1969 | Cornell . |
| 3,586,273 | 6/1971 | Sloyan . |
| 4,133,508 | 1/1979 | Sloyan . |
| 4,252,380 | 2/1981 | Sloyan . |

*Primary Examiner*—Henry Bennett

*Attorney, Agent, or Firm*—Lockwood, Alex, Fitzgibbon & Cummings

[57] ABSTRACT

An improved stationary refrigeration unit having a cooling compartment and a service compartment is provided for installation in tight quarters for vehicles, the service compartment having an access door on the same side of the unit as the cooling compartment access door, components readily accessible and adjustable through the service compartment door, and an adjustable component mounting assembly rigidly mounted within the service compartment. The adjustable mounting assembly includes a stationary carriage, a mounting member slidably mounted to the stationary carriage, and an assembly longitudinally moving the mounting member and the component attached thereto relative to the stationary carriage. The mounting assembly includes a first shaft in driving engagement with the mounting member and a second shaft horizontally offset from the first shaft and in operative engagement with the first shaft whereby rotation of the second shaft rotates the first shaft and longitudinally moves the mounting member relative to the stationary carriage.

28 Claims, 8 Drawing Figures

VEHICLE REFRIGERATION UNIT AND MOUNTING ASSEMBLY

BACKGROUND AND SUMMARY OF THE INVENTION

This invention relates to an improved water cooler or refrigeration unit adapted to be installed in railway vehicles and relates more particularly to such a device having components that are readily serviced through a service door, including a slidable component mounting adjustment mechanism located within a service compartment of the device.

Railroad union contracts often require that a refrigerator or water cooler be located within a railway vehicle such as a locomotive or a caboose, for the use thereof by train crews. Due to the uneven levels of grades encountered by trains in transit, the mounting of such a refrigerator or water cooler by its weight alone is impractical, for the unit may shift and slide in response to the swaying or jolting experienced by the railroad vehicle. It therefore becomes necessary that the refrigerator be rigidly attached to the floor of the vehicle in which it is placed. The components which supply refrigeration to the cooling compartment must likewise be rigidly attached to the unit such that they are restrained from movement within the service compartment.

Such refrigeration units are usually positioned within the railway vehicle at a location that permits access to only one vertical side of the unit. This restricted access to the unit at times requires that the unit be removed from its in-use location when maintaining or repairing the unit.

Typically, the unit is usually securely fastened at its in-use location by either bolting or welding the unit to the floor. This method of attachment tends to be permanent in nature rather than temporary. This type of somewhat permanent mounting renders the task of removing or moving the unit even more difficult when it is necessary to gain access to the internal refrigeration components in order to perform service or maintenance functions.

A typical refrigeration unit has two compartments, a cooling compartment to cool articles stored therein, and a service compartment that contains the internal mechanical components of the refrigeration unit, such as a condenser, compressor, electric motor, pulleys and flywheels, and associated connections to the components. Location of an access cover or door in the front panel of a refrigeration unit to allow access to the mechanical components therewithin does not always alleviate the necessity of removing the entire refrigerator unit.

When the refrigeration components are not easily accessible or are permanently attached to the base of the service compartment, simple maintenance tasks such as tightening or replacement of drive belts, replacement of motor brushes or recharging of compressor refrigerant can require the removal of the entire unit from its location and occasionally from the vehicle itself. This removal expends substantial labor and time, and the railway vehicle can be even withdrawn from productive use. With the invention as described herein, the occasions when the entire unit must be removed for maintenance or repair are substantially eliminated.

An improved vehicle refrigerator in accordance with the present invention includes a cooling compartment and a service compartment which share a common wall. The service compartment contains associated refrigeration components such as a motor and compressor mounted upon generally parallel respective axes, a hinged condenser located on the inside of the service compartment access door, and a novel adjustable mounting assembly which mounts one or more components in a manner that provides for longitudinal movement of the component within the service compartment by the operation of a handle that is readily accessible from the service compartment access opening. This movement capability provides greater access to component connections as well as to the components mounted thereon and components mounted therebehind.

In an important aspect of this invention, a mounting assembly is provided which includes a slidable mounting member held in sliding contact between the guiderails of a stationary carriage that is secured to the floor of the service compartment. A rotatably mounted first shaft generally disposed between the guiderails receives a support plate of the mounting member. This first shaft engages a traveling follower member and further engages a second shaft substantially horizontally offset therefrom such that the operation of a handle on the second shaft accessible from outside the mounting assembly moves the mounting member and a component secured thereto in a direction generally parallel to the first shaft.

Another important feature of the invention resides in a limitation and control upon the movement of the mounting assembly, preventing any substantial reverse movement from that selected.

Accordingly, it is a general object of the invention to provide an improved stationary refrigeration unit for a vehicle.

Another object of the invention is to provide, in a refrigeration unit service compartment, an adjustable mounting assembly to which may be attached either a belt driven or belt driving device, the assembly being capable of slidably adjustable movement within the service compartment area.

Another object of the invention is to provide an improved service compartment in a refrigerator such as characterized above, wherein the internal refrigeration components are mounted such that they are capable of adjustable movement so that the position of the components can be varied allowing easy access for purposes of maintenance and repair.

Still another object of the invention is to provide a mounting assembly capable of reciprocating movement, wherein the adjustment mechanism is located generally perpendicularly to the axis of reciprocatable movement.

Still another object of the invention is to provide an adjustable mounting assembly capable of controlled reciprocating movement wherein the movement selected is stabilized and prevented from any substantial movement in the direction opposite of that selected.

These and other objects of the present invention will become apparent from the following detailed description of the preferred embodiment of this invention, taken in conjunction with the accompanying drawings, wherein:

DESCRIPTION OF THE PREFERRED EMBODIMENT

Figure 1:
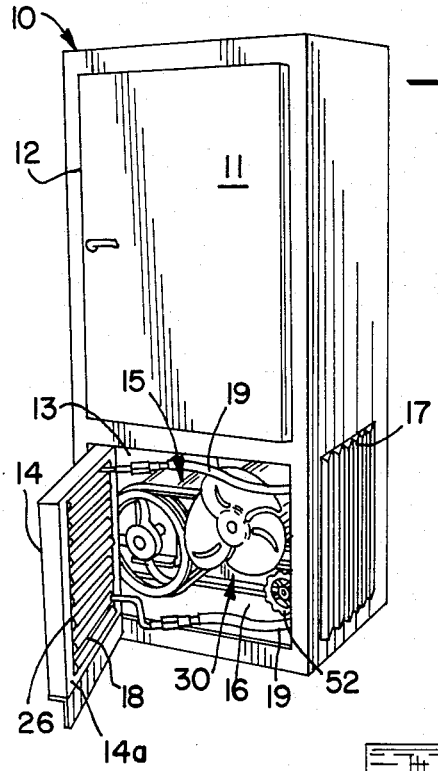
FIG. 1 is a perspective view of the refrigeration unit in accordance with this invention, with the service compartment access door in an open position showing typical locations of refrigeration components therein.
Figure 2:
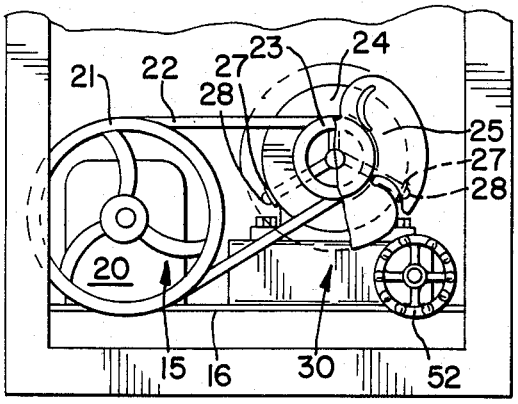
FIG. 2 is an enlarged front elevational view of the service compartments illustrated in FIG. 1.

Referring now to the drawings, and to FIGS. 1 and 2 in particular, there is shown a stationary refrigeration unit 10 containing an upper cooling compartment 12 having an access door 11 and a lower service compartment 13. The service compartment also has an access door 14 to allow entrance to the service compartment 13 for examining and servicing the refrigeration component assembly, generally depicted as 15. The service compartment 13 has a floor 16 to which are mounted components of the refrigeration assembly 15. Louvered side panels 17 may be included for allowing air flow into the service compartment 13. Additionally, it can be seen in the embodiment depicted that both the cooling compartment and the service compartment share common side walls.

The refrigeration assembly 15 of the invention can include a compressor 20 having a flywheel 21 mounted on the compressor drive shaft. The compressor flywheel 21 is drivingly connected by a drive belt 22 to a companion pulley 23 mounted on the drive shaft of a motor 24. Mounted coaxially on the same shaft as pulley 23 is a fan 25 that enhances the flow of air through a condenser 26 and its condenser tubing 18. The compressor 20 is manufactured and mounted so that its refrigerant charging apertures are located on the end facing the service compartment access door, while the motor 24 also has its electrical generator brushes located on the motor end that faces the access door. The brush covers 27 have oversized, protruding gripping members, such as knobs 28, attached to their exterior ends to allow for simplified removal of the brushes for inspection, replacement or repair purposes.

The condenser 26 is hinged in that its cooling tubes 18 are attached to the inside face 14*a* of the service compartment access door 14 and is provided with flexible connections 19 that allow the condenser 26 to be swung out of the path of the refrigeration assembly 15 in order to facilitate servicing of the condenser 26 and the other components of the refrigeration assembly 15.

In the embodiment illustrated, the motor 24 is mounted onto an adjustable mounting assembly, generally designated as 30, such that the drive shaft of the motor 24 is generally transverse to the access door 14 of the service compartment. The compressor 20, as illustrated, is rigidly mounted to the service compartment floor 16, although it is possible to mount either or both of motor 24 and compressor 20 onto its own adjustable mounting assembly on the order of assembly 30.

In any event, the motor 24 and the compressor 20 are movable with respect to each other such that the spacing therebetween is adjustable. The use of the adjustable mounting assembly 30 as shown in the preferred embodiment serves to move the motor 24 either nearer to or farther from the compressor 20, allowing the drive belt 22 to be tightened, loosened or removed from the respective generally parallel drive shafts of the motor 24 and the compressor 20.

Figure 3:
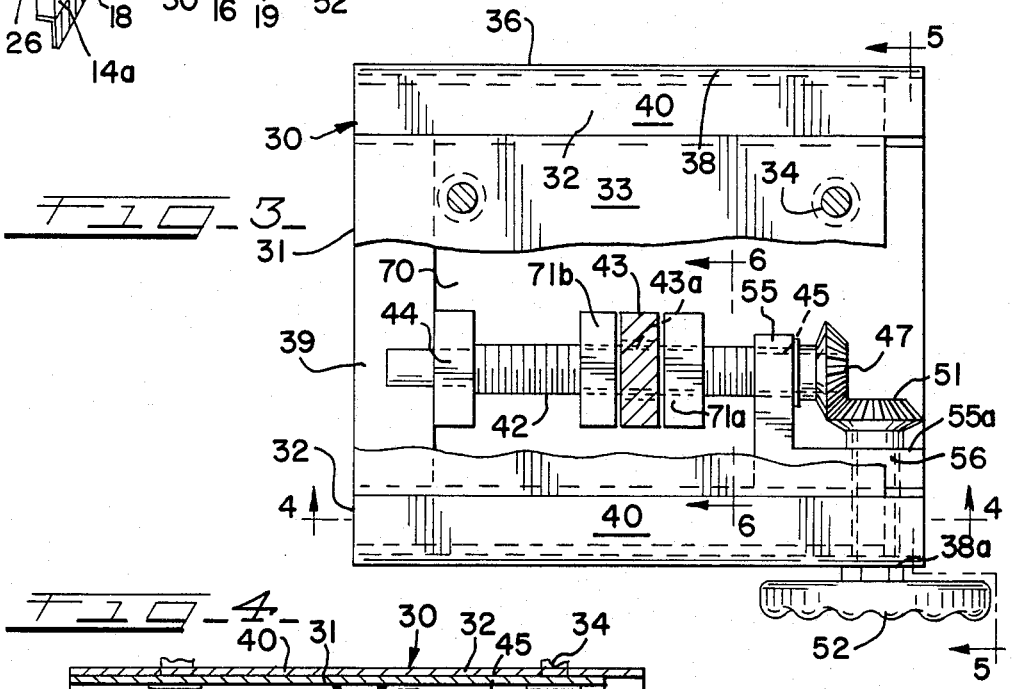
FIG. 3 is a plan view of the preferred adjustable component mounting mechanism with a portion of the mounting member being cut away.
Figure 4:
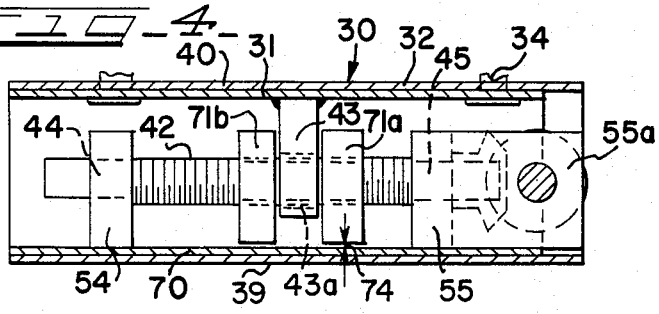
FIG. 4 is a sectional view taken along line 4—4 of FIG. 3.
Figure 5:
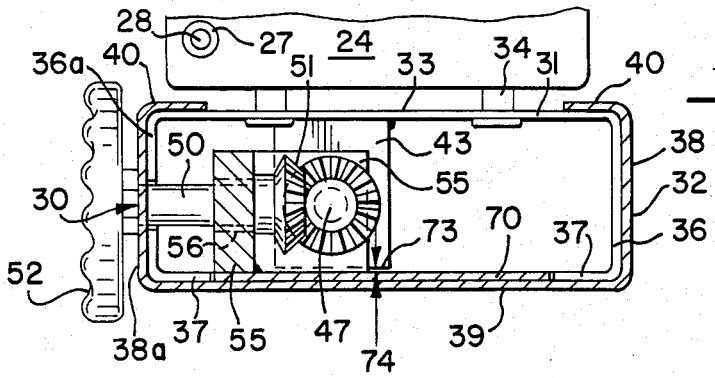
FIG. 5 is a partial sectional view taken along line 5—5 of FIG. 3.

Referring to FIGS. 3, 4 and 5, the mounting assembly 30 of the embodiment shown incorporates a mounting member 31 and a carriage 32. The mounting member 31 includes a motor support portion 33 to which the motor 24 or other component is secured by bolts 34, by welding, or by any other suitable means. The side edges of the support portion 33 are bent downwardly from the support plate to form a pair of flanges 37 that extend inwardly from the depending legs 36. The flanges 37 slidably engage a base portion 39 of the carriage and an alignment plate 70 of the carriage 32 while the depending legs 36 slidably engage carriage guiderails 38. The mounting member 31 has an inverted, generally U-shaped transverse configuration.

Carriage 32 itself is attached to the service compartment floor by suitable means so that the carriage 32 is stationary relative to the mounting member 31. The depending legs 36 of the mounting member 31 are received by twin carriage guiderails 38 that extend upwardly from the carriage base portion 39. Each guiderail 38 includes an inwardly extending flange 40 that is generally parallel to the base portion 39 thereby providing a guide for the slidable engagement of the mounting member 31 with the carriage 32.

It will be noted that the carriage 32 has a generally U-shaped transverse configuration, and its internal dimensions are slightly larger than the external dimensions of the mounting member 31 such that the mounting member 31 upon which the motor 24 is mounted is in slidable engagement with the carriage 32. Both the mounting member flanges 37 and the carriage guiderail flanges 40 serve in conjunction with an alignment plate 70 to properly align and retain the mounting member 31 in slidable engagement within the carriage 32. The alignment plate 70 is attached to the carriage base portion 39 between the carriage guiderails 38 and urges the mounting member depending legs 36 and leg flanges 37 into slidable contact with the carriage guiderails 38 and carriage base portion 39, respectively.

Figure 6:
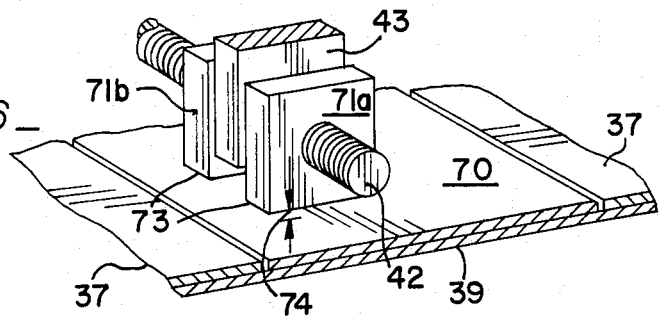
FIG. 6 is a perspective view taken generally along the line 6—6 in FIG. 3.

Movement of the mounting member 31 is effected by the use of two rotatable shafts 42 and 50. A threaded first advancement shaft 42 is internally disposed within both the guiderails 38 and the depending legs 36 of the carriage 32 and mounting member 31. As shown in the preferred embodiment, an advancement lug 43 is attached to the bottom of support plate 33 and receives the threaded shaft 42. The lug 43 is not threaded. Preferably, an opening 43*a* in the advancement lug is oversized to the extent that it has a diameter larger than the diameter of the threaded shaft 42 so that there is no contact between the threaded shaft 42 and the advancement lug 43. Subsequently, the lug 43 can neither rotate nor advance by itself along the shaft. On each side of the lug 43 there is a threaded follower member 71*a*, 71*b* that is threadedly received by the first shaft 42. As shown more clearly in FIG. 6, the followers 71*a*, 71*b* have generally flat bottom ends 73. A minimum clearance 74 is established between the follower bottom ends 73 and the carriage base portion 39 such that the followers 71*a*, 71*b* are prevented from any substantial co-rotation with the first shaft 42, due to the interference with their rotation by base portion 39. The followers thereby advance along first shaft 42 in response to shaft rotation. By so advancing, the followers 71*a*, 71*b* urge the lug 43 to move along the first shaft 42, thereby moving the mounting member 31.

Threaded shaft 42 is rotatably mounted in two openings 44 and 45 (FIGS. 3 and 4), contained in supports 54 and 55, respectively. The supports 54 and 55 are secured to the carriage base portion 39, each supporting an end portion of the threaded shaft 42. The portions of the advancement shaft 42 that are received by the openings 44 and 45 are not threaded so that the shaft 42 is capable of non-translating rotation within the openings. One end portion of the shaft 42 is seated in opening 44, while the opposite end of the shaft 42 includes an endgear 47 that projects beyond the other opening 45.

In the preferred embodiment, the clearance between the advancement lug 43 and the follower members 71*a*, 71*b* is kept to a minimum to maintain the position of the mounting member 31 relative to that of the stationary carriage 32. As mentioned above, the adjustable mounting mechanism 30 may be used to increase the tension on the drive belt 22 (FIGS. 1 and 2) that connects the motor 24 with the compressor 20. When the tension is increased, the belt 22 will exert a force upon the motor 24, tending to draw it towards the compressor 20. This force is transmitted to the mounting member 31 to which the motor 24 is attached, tending to urge the advancement lug 43 along the shaft 42. If the advancement lug 43 were to move substantially in response to this force, the tension in the belt 22 would be undesirably reduced.

This aspect of the present invention precludes such an undesirable effect. Due largely to the oversized character of the opening 43*a* of the lug 43, the generally linear force created by tension within the drive belt 22 is not converted to a rotational force along the shaft 42 which would tend to rotate the follower 71*b*. In fact, this force is transmitted to the lug 43 to the extent that it abuts the follower 71*b* and applies pressure thereto in a non-rotational manner, which assists in stabilizing the location of the follower 71*b* along the shaft 42. Such location stabilization of the follower 71*b* is further enhanced by virtue of the minimum clearance 74 (FIGS. 4, 5 and 6), whereby the respective bottoms 73 of the followers 71*a* and 71*b* butt against the carriage base portion 39 to prevent any substantial rotation and linear movement of the followers 71*a* and 71*b* unless the shaft 42 rotates.

Such transmission of the tension in the belt 22 to the lug 43, followers 71*a* and 71*b*, and shaft 42 maintains a threshold force that must be overcome before the shaft 42 will rotate. This threshold force is of such a magnitude that it can be overcome by rotation of the handle 52, but it will not be overcome by typically experienced outside forces, such as those generated by the rocking, swaying and vibrational forces that are developed when railway equipment is in use.

With more particular reference to the operative interengagement between the first shaft 42 and the second shaft 50, these shafts are mounted such that they are generally horizontally offset with respect to each other. The second shaft 50 is mounted through an opening 56 of a support 55*a* that is generally perpendicular to the support 55. If desired, the support 55*a* may, as illustrated, be joined to the support 55. In order to provide a stable, rotatable mounting of the second shaft 50, it is further rotatably mounted through both the guiderail 38*a* and the depending leg 36*a*. (See FIG. 5.)

Regarding the endgear arrangement illustrated in FIGS. 3, 4 and 5, the innermost end of the second shaft 50 includes an endgear 51, similar to the first shaft endgear 47. A handle 52 is included on the opposite end of the second shaft 50, outside the guiderail 38*a*. The first shaft 42 and the second shaft 50 operatively engage each other at the two endgears 47 and 51, preferably at a horizontal angle such that the shafts 42, 50 are substantially transverse to each other. As can be seen in FIGS. 1 and 2, the handle 52 is easily accessible within the service compartment 13.

Rotation of the handle 52 turns the endgear 51 of the second shaft 50, which rotates the first shaft endgear 47 thereby rotating the threaded shaft 42 to thereby move the lug 43 to the right or to the left, dependent on the direction of rotation of the handle 52. The advancement lug 43 secured to the bottom of the support portion 33 causes the mounting member 31 to move within the guiderails 38 of the carriage 32. Depending legs 36 and inward flanges 37 of the mounting member 31 accordingly move in slidable engagement within the carriage guiderails 38.

Both supports 54 and 55 (FIGS. 3 and 4) provide a limitation on the axial movement of lug 43 along first shaft 42, thereby precluding the possibility of disengaging the mounting member 31 and the lug 43 from the first shaft 42. Spacers (not shown) can be placed on first shaft 42 between either or both of the supports 54 and 55 and the threaded follower 71 to further restrict the longitudinal movement of the mounting member 31 and of the component mounted upon its support portion 33.

Figure 7B:
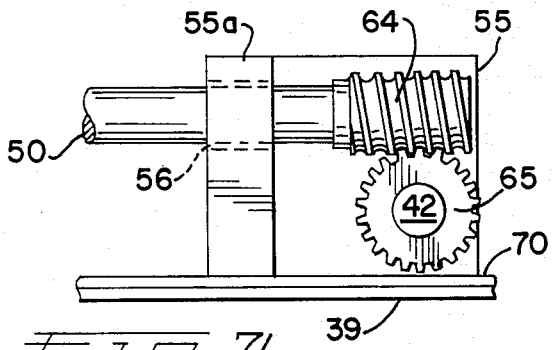
FIGS. 7*a* and 7*b* depict alternative drive gear arrangements for the adjustable component mounting mechanism.
Figure 7A:
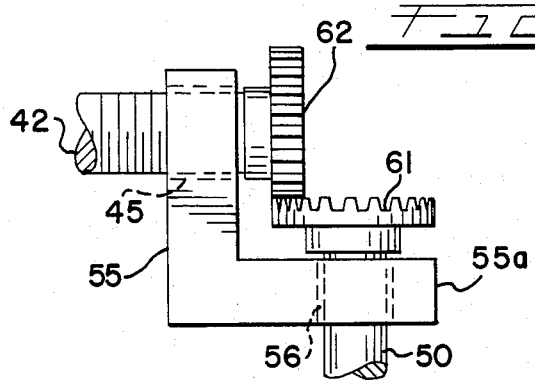

The endgear arrangement shown in the preferred embodiment, especially in FIGS. 3 through 5, utilizes twin bevelled gears 47 and 51. However, other endgear arrangements utilizing offset gears are suitably employed, such as those depicted in FIGS. 7*a* and 7*b*. FIG. 7*a* illustrates the use of a generally perpendicular gear arrangement utilizing a face gear 61 as the endgear of the second shaft 50 that passes through opening 56 of the support 55*a*. Face gear 61 engages a spur gear 62 which is the endgear of the first shaft 42 that passes through opening 45 of the support 55. It is to be noted that the respective positions of the face gear 61 and of the spur gear 62 may be interchanged for operation. Another suitable endgear arrangement is illustrated in FIG. 7*b* wherein the first shaft endgear of the first shaft 42 is a wheel gear 65 that is driven by a worm gear 64 of the second shaft 50 mounted through opening 56 of the support 55*a*.

By use of the adjustable mounting mechanism within a refrigeration unit as herein described, it is possible to change the location of the motor 24 with respect to the compressor 20 for maintenance or service duties which previously could have necessitated the removal of the entire refrigeration unit. With this combination, the tension on the drive belt 22 can be adjusted, the replacement of the belt can also easily be facilitated, and the motor 24 can be moved about the service compartment 13 to gain greater access to the various other components of the refrigeration assembly 15.

The foregoing description of the invention is intended to illustrate the principles and features thereof and should not be understood to limit the invention, since modifications and variations would suggest themselves to those skilled in the art without departing from the spirit of the invention, the scope of which is set forth in the appended claims.

What is claimed is:

1. An improved stationary refrigeration unit adapted to be installed in vehicles, the unit being of the type having a cooling compartment and a service compartment, comprising in combination:

a compartment for cooling articles stored therein below ambient temperature, said compartment having a door to gain access thereto;

a service compartment sharing a common wall with said cooling compartment and having a service compartment access opening along the same side of the unit as the cooling compartment access door, said service compartment including a motor and components driven thereby for cooling said cooling compartment to a temperature below ambient temperature, said motor having a drive shaft that is generally transverse to said service compartment access opening;

an adjustable mounting assembly rigidly mounted within said service compartment, said mounting assembly including a stationary carriage and a mounting member, said mounting member being slidably mounted to said stationary carriage, and at least one of said components is secured to said mounting member; and said adjustable mounting assembly includes means for longitudinally moving said mounting member and said component attached thereto relative to said stationary carriage, said moving means including a first shaft in driving engagement with said mounting member and a second shaft horizontally offset from said first shaft, said first shaft being in operative engagement with said second shaft whereby rotation of said second shaft rotates said first shaft and longitudinally moves said mounting member and said component attached thereto.

2. A refrigeration unit in accordance with claim 1, wherein said adjustable mounting assembly further includes means for limiting the longitudinal movement of said mounting member.

3. A refrigeration unit in accordance with claim 1, wherein said stationary carriage includes upwardly extending guiderails having a base portion therebetween and said mounting member includes downwardly extending legs having a support plate therebetween.

4. A refrigeration unit in accordance with claim 1, wherein said longitudinal movement means further includes an advancement lug, said lug depending from said mounting member and having an oversized opening therein, and a follower member threadedly received by said first shaft, said follower substantially abutting said advancement lug.

5. A refrigeration unit in accordance with claim 1, wherein said longitudinal movement means further includes an advancement lug depending from said mounting member, said lug being received by said first shaft, and twin follower members threadedly received by said first shaft on opposite sides of said advancement lug whereby rotation of said first shaft longitudinally advances said followers along said first shaft and said followers urge said lug therebetween along said first shaft.

6. A refrigeration unit in accordance with claim 5, wherein each of said twin followers includes a stop surface thereon that engages a portion of said mounting assembly, said stop surfaces substantially limiting the rotation of said followers with respect to said first shaft.

7. A refrigeration unit in accordance with claim 4, wherein said longitudinal movement means further includes twin follower members threadedly received by said first shaft on opposite sides of said advancement lug, said followers substantially abutting said advancement lug whereby rotation of said first shaft longitudinally advances said followers and said lug therebetween along said first shaft, each of said followers having a stop surface thereon that engages a portion of said adjustable mounting assembly thereby limiting the rotation of said followers with respect to said first shaft.

8. A refrigeration unit in accordance with claim 5, wherein the ends of said first shaft are rotatably mounted onto said carriage base portion, said advancement lug is received by said first shaft between said mounts, said second shaft is rotatably mounted onto said carriage base portion, and said first shaft mounts limit longitudinal travel of said advancement lug on said first shaft.

9. A refrigeration unit in accordance with claim 1, further including mounting member alignment means including a flange extending from said mounting member and an alignment plate of the stationary carriage, said mounting member flange being in slidable engagement with said alignment plate.

10. A refrigeration unit in accordance with claim 1, wherein said first shaft and said second shaft further include an endgear thereupon, said first shaft endgear enmeshingly engaging said second shaft endgear.

11. A refrigeration unit in accordance with claim 3, wherein said mounting member downwardly extending legs slidably engage said stationary carriage guiderails, said second shaft extending through one of said carriage guiderails and one of said mounting member legs.

12. A refrigeration unit in accordance with claim 1, wherein said second shaft is offset generally perpendicularly to said first shaft.

13. A refrigeration unit in accordance with claim 1, wherein each of said first and second shafts has a bevelled endgear thereon, and said first shaft bevelled endgear enmeshingly engages said second shaft bevelled endgear.

14. A refrigeration unit in accordance with claim 1, wherein said second shaft is offset generally perpendicularly to said first shaft, and wherein each of said first or second shafts has an endgear thereon, one of said endgears being a face gear having its teeth disposed perpendicularly to the axis of its shaft and the other endgear being a spur gear having its teeth disposed parallel to the axis of its shaft.

15. A refrigeration unit in accordance with claim 1, wherein said second shaft is offset generally perpendicularly to said first shaft, and wherein each of said first and second shafts has an endgear thereon, one of said endgears being a worm gear and the other of said endgears being a wheel gear.

16. A refrigeration unit in accordance with claim 1, wherein said service compartment access door includes a condenser, said condenser being flexibly connected to said motor driven components whereby said condenser is removed from said service compartment by operation of said access door.

17. A refrigeration unit in accordance with claim 1, wherein said motor includes motor brush covers having oversized, protruding gripping members thereon, in close proximity to said service compartment access door, wherein by said brush covers are accessible when said service compartment access door is opened.

18. An adjustable mounting support assembly for mounting a motor or the like, comprising a stationary carriage and a mounting member, said mounting member having a motor or the like secured thereto, and means for longitudinally moving said mounting member and said motor or the like attached thereto relative to said stationary carriage, said moving means including a first shaft in driving engagement with said mounting member, a second shaft horizontally offset from said first shaft, said first shaft being in operative engagement with said second shaft whereby rotation of said second shaft rotates said first shaft and longitudinally moves said mounting member and attachment thereto, said first shaft being rotatably mounted onto said carriage base portion, said second shaft also being rotatably mounted onto said carriage base portion, an advancement lug depending from said mounting member and having an oversized opening therein, and said longitudinal movement means further includes follower members threadedly received by said first shaft on opposite sides of said advancement lug, said follower members substantially abutting said advancement lug whereby rotation of said first shaft longitudinally advances said followers and said advancement lug therebetween along said first shaft, each of said follower members having a stop surface thereon that engages a portion of said adjustable mounting assembly thereby limiting the rotation of said follower members with respect to said first shaft.

19. An adjustable mounting support assembly in accordance with claim 18, wherein said assembly further includes means for limiting the longitudinal movement of said mounting member.

20. An adjustable mounting support assembly in accordance with claim 18, wherein said stationary carriage includes upwardly extending guiderails having a base portion therebetween and said mounting member includes downwardly extending legs having a support plate therebetween.

21. An adjustable mounting support assembly in accordance with claim 18, wherein the ends of said first shaft are rotatably mounted on opposite ends of said first shaft, said advancement lug is received by said first shaft between said mounts, and said first shaft mounts limit longitudinal travel of said advancement lug on said first shaft.

22. An adjustable mounting support assembly in accordance with claim 18, further including mounting member alignment means including a flange extending from said mounting member and an alignment plate of the stationary carriage, said mounting member flange being in slidable engagement with said alignment plate.

23. An adjustable mounting support assembly in accordance with claim 18, wherein first shaft and said second shaft further include an endgear thereupon, said first shaft endgear enmeshingly engaging said second shaft endgear.

24. An adjustable mounting support assembly in accordance with claim 18, wherein said mounting member downwardly extending legs slidably engage said stationary carriage guiderails, said second shaft entending through one of said carriage guiderails and one of said mounting member legs.

25. An adjustable mounting support assembly in accordance with claim 18, wherein said second shaft is offset generally perpendicularly to said first shaft.

26. An adjustable mounting support assembly in accordance with claim 18, wherein each of said first and second shafts has a bevelled endgear thereon, and said first shaft bevelled endgear enmeshingly engages said second shaft bevelled endgear.

27. An adjustable mounting support assembly in accordance with claim 18, wherein said second shaft is offset generally perpendicularly to said first shaft, and wherein each of said first or second shafts has an endgear thereon, one of said endgears being a face gear having its teeth disposed perpendicularly to the axis of its shaft and the other endgear being a spur gear having its teeth disposed parallel to the axis of its shaft.

28. An adjustable mounting support assembly in accordance with claim 18, wherein said second shaft is offset generally perpendicularly to said first shaft, and wherein each of said first and second shafts has an endgear thereon, one of said endgears being a worm gear and the other of said endgears being a wheel gear.

* * * * *